US006979372B1

(12) United States Patent
Otten et al.

(10) Patent No.: US 6,979,372 B1
(45) Date of Patent: Dec. 27, 2005

(54) METHOD FOR CLEANING PARTICLE CLASSIFIER

(75) Inventors: Peter J. A. Otten, Maasbracht (NL); Robert H. Buijtendijk, Venray (NL)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/179,831

(22) Filed: Jul. 13, 2005

(51) Int. Cl.[7] ..... B08B 7/00

(52) U.S. Cl. ..... 134/6; 134/7; 134/8; 134/22.1; 134/22.11; 134/22.18; 134/23; 134/34; 134/42

(58) Field of Search ..... 134/6, 7, 8, 22.1, 134/22.11, 22.18, 33, 34, 42

(56) References Cited

U.S. PATENT DOCUMENTS 6,004,400 A * 12/1999 Bishop et al. ..... 134/2
2003/0232266 A1 * 12/2003 Sugiura et al. ..... 430/107.1

* cited by examiner

*Primary Examiner*—Sharidan Carrillo
(74) *Attorney, Agent, or Firm*—Eugene O. Palazzo; Fay, Sharpe, Fagan, Minnich & McKee, LLP

(57) ABSTRACT

A method for cleaning portions of a particle classifier, such as for example the rotor and/or stator, includes providing carbon dioxide particles to the classifier. Carbon dioxide particles are supplied to the classifier via a particle inlet and subjected to processing conditions similar to those utilized in particle classification. Cleaning a classifier with carbon dioxide particles may be accomplished off-line or on-line.

20 Claims, 1 Drawing Sheet

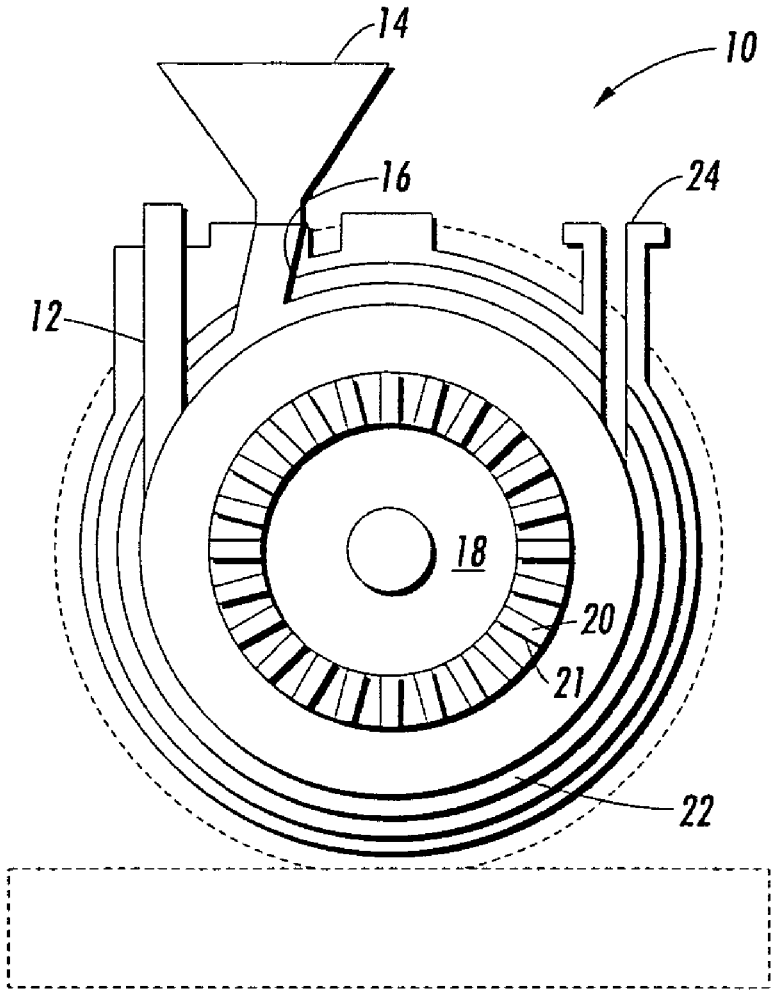
14
10
16
24
12
18
20
21
22

METHOD FOR CLEANING PARTICLE CLASSIFIER

BACKGROUND

The present disclosure relates, in various embodiments, to a method of cleaning a particle classifier. In particular, the present disclosure relates to a method of removing particle and material build-up from the rotor and/or stator of a classifier, which may occur during classification of particle materials. While the method is described with respect to removing toner build-up that occurs during classification of toner particles, such as may be used in a photo or electrostatographic imaging apparatus, the method is amenable to removing the build-up of other particle materials that are subject to classification processes.

Particle separation of particle materials, such as, for example, toner particles, is typically accomplished by particle classification using a classifier. Classification allows for particles of a desired size and/or size to be separated from larger, unwanted particles.

One problem associated with particle classification is that material builds up at the inside of the stator ring during classification. Material build-up results from several factors including high particle velocity in the classifier, fusing properties of the particles/materials, and the relatively high temperature of the stator ring during classification. Particle/material build-up reduces the efficiency of the classification and may be a source for the generation of excessively large particles.

Because particle/material build-up on the stator ring is undesirable, periodic cleaning of the stator and classifier is required. The frequency with which the stator must be cleaned depends on the use of the classifier and the desired output. In some instances, it may be necessary to clean the classifier on a daily basis. One problem associated with cleaning the rotor or stator of a classifier is that the classifier must be opened or disassembled to clean the selected part such as by manually scraping the build-up off the stator. This results in down time in which the classifier cannot be operated. For example, maintenance time associated with removing toner particle build-up is typically on the order of about one hour.

Another problem associated with conventional classifier cleaning techniques is that the cleaning material may contaminate or pollute the particle material. Chemical cleaning solutions may leave behind a residue or may not be completely removed from the classifier such that particles processed in the classifier may become contaminated. Cleaning the rotor with small polymer particles or iron particles may also contaminate the particles being classified. Contaminated particles may not properly function in the manner in which they were intended to function.

Classifying toner particles used for electrostatographic imaging device presents still another problem. Toner screening has been switched from screening over a 75 micron screen to screening over a 44 micron screen. The reduced screen size results in reduced throughput and short screen life due to blinding.

Thus, it is desirable to provide a method for cleaning a particle classifier that reduces or eliminates the time period during which the classifier cannot be used while the classifier is cleaned. Additionally, it is desirable to provide a method for cleaning a classifier that reduces or eliminates the potential for the particles being classified to become contaminated by the cleaning material.

BRIEF DESCRIPTION

This disclosure relates, in embodiments thereof, to a method for cleaning a particle classifier having a material inlet, a classifier wheel, a rotor, a stator ring, a material outlet, and particle build-up on at least one of the rotor and the stator, the method comprising providing carbon dioxide particles to at least on of the rotor and the stator, and allowing the carbon dioxide particles to interact with the particle build-up to break up the particle build-up.

Additionally, the disclosure, in embodiments thereof, also includes a method of cleaning a particle classifier having a material inlet, an air inlet, an air outlet, a material outlet, a classifier wheel having a rotor and a stator ring, and particle build-up on at least one of the rotor and the stator, the method comprising stopping a process for classifying particles, feeding carbon dioxide particles through the material inlet of the classifier, and operating the rotor thereby allowing the carbon dioxide particles to interact with and remove the particle build-up.

Further aspects of the disclosure, in various embodiments thereof, include a method for cleaning a particle classifier having a material inlet, an air inlet, an air outlet, a material outlet and a classifier wheel having a rotor and a stator ring, the method comprising providing particles to be classified; providing carbon dioxide particles; feeding particles to be classified to the classifier wheel; operating the classifier wheel and performing a classification process; and feeding the carbon dioxide particles to the classifier wheel through the material inlet during the classification process.

These and other non-limiting features and characteristics of the disclosure are further described herein.

BRIEF DESCRIPTION OF THE DRAWINGS

The following is a brief description of the drawings, which are presented for the purpose of illustrating exemplary embodiments disclosed herein and are not intended to limit the same.

FIG. 1 is schematic cross sectional view of an air classifier for classifying particles.

DETAILED DESCRIPTION

The present disclosure relates to a method for cleaning a particle classifier by applying carbon dioxide particles to a classifier to remove build-up of any particle materials from, for example, the stator of the classifier. As used herein, particle build-up refers to the accumulation of material or particles that are being classified, i.e., the desired particle products, and does not refer to any accumulation of carbon dioxide particles that may occur if the carbon dioxide particles are present in a classifier wheel along with material or particles that are being classified.

With reference to FIG. 1, a conventional air classifier is shown. Air classifier 10 includes an air inlet 12, a material inlet 14 with inlet tube 16 for feeding particle material into the classifier, a rotor 18, a classifier wheel 20, stator 22, and a particle outlet 24. Generally, air is introduced into the classifier via air inlet 12 and passes through a gap between the halves of the rotor 18 and the stator 22, thereby creating a turbulent, spiral flow of air. Material is fed into the air flow via material inlet 14 and inlet tube 16. A classification zone is created between the outer edge of blades 21 and the periphery of the rotor. Coarse material, which is rejected and undesirable, is discharged through a course product outlet (not shown). Fine product of the desired size(s) are carried through the classifier wheel and to a material outlet 24. As particles are moved through the classifier and out of the coarse or fine material outlets, material agglomerates and/or build-ups on the stator ring due to several reasons including, the velocity of the particles, the fusing properties of the particles, and the relatively high temperature of the stator ring.

In accordance with the present disclosure, the stator ring and other portions of the classifier are cleaned by providing carbon dioxide particles (i.e., dry ice particles) and applying the carbon dioxide particles to the areas of the classifier exhibiting a build-up of particles. The carbon dioxide particles are applied to the areas exhibiting particle build-up by feeding the carbon dioxide particles into the classifier such that the particles enter the air stream and are exposed to the various areas of the classifier in the same manner as are particles to be classified. Without being bound to any particular theory, the carbon dioxide particles enter the classifier, are subjected to the turbulent air flow, are conveyed throughout the classifier, and contact areas of the classifier such as, for example, the stator. When the flowing carbon dioxide particles contact areas with particle build-up, the carbon dioxide particles essentially bombard the material build-up with a force sufficient to break up the build-up so that the particle material may re-enter the air flow and be removed from the classifier.

The size of the carbon dioxide particles is not limited in any manner and may be selected as desired to sufficiently effectuate cleaning of the classifier.

One advantage of using carbon dioxide is that it sublimates. That is, solid carbon dioxide passes from the solid state to the gaseous state without entering the liquid phase. Thus, solid carbon dioxide provides a cleaning material that does not require additional time or expense to remove and/or dispose of liquids that may collect in the classifier. Additionally, carbon dioxide dramatically reduces or eliminates the possibility that the cleaning material will contaminate the toner as the stator is cleaned because i) the carbon dioxide is non-toxic and ii) solid carbon dioxide becomes a gas.

In one embodiment, the classifier is cleaned after a classification process is stopped and the free particles including both the fine and coarse particles are discharged from the classifier via the appropriate outlet. To clean the stator or other components of the classifier, carbon dioxide particles are fed into the classifier via the material inlet (e.g., inlet 14). The carbon dioxide particles are subjected to the turbulent air flow and are passed through the classifier contacting and removing particle areas of particle build-up.

In embodiments, cleaning is improved or optimized at lower carbon dioxide sublimation rates. The sublimation rate of the carbon dioxide particles may be controlled by varying process conditions during cleaning of the classifier including, but not limited to, the air flow rate, the rotor speed, and whether the material outlets of the classifier are opened or closed. In one embodiment, cleaning occurs while operating the classifier at a low air flow, a high rotor speed (rpm) and with the material outlets closed. Examples of suitable air flow rates include, but are not limited to, an air flow of from about 250 $m^3$/hr to about 500 $m^3$/hr. Examples of suitable rotor speeds include, but are not limited to, rotor speeds of from about 3,000 rpm to about 3,500 rpm.

Cleaning the rotor in the above manner does result in some down time since the particle classification is stopped and particles are not added to the classifier during cleaning. The down time, however, is reduced relative to conventional cleaning methods in that the classifier may not have to be opened up to effect cleaning of the stator or other parts. In one embodiment, a classifier may be cleaned with carbon dioxide particles in less than about 30 minutes. In another embodiment, a classifier may be cleaned with carbon dioxide particles in less than about 15 minutes. In still another embodiment, a classifier may be cleaned with carbon dioxide particles in less than about 10 minutes. In a further embodiment, a classifier may be cleaned with carbon dioxide particles in about 5 minutes.

In another embodiment, the classifier is cleaned on-line during classification of the particle material. On-line cleaning is accomplished by feeding the carbon dioxide (cleaning) particles into the classifier via the material inlet during a particle classification operation. The cleaning particles may be fed to the classifier prior to, along with, or subsequent to the addition of particle materials to be classified. It will be appreciated that simultaneously feeding particles to be classified and carbon dioxide particles encompasses, but is not limited to, the situation in which particles to be classified and carbon dioxide cleaning particles are generally intermixed upon entry into the classification wheel. In embodiments on-line cleaning reduces the build-up of particle materials during classification such that cleaning of the classifier may be completed "off-line," i.e., at a time after particle classification is stopped, in less time than would be required if cleaning were done completely off-line. In other embodiments, on-line cleaning prevents any build-up from occurring during classification such that off-line cleaning is not required. That is, in some embodiments, on-line cleaning provides a generally continuous supply of carbon dioxide particles to effectuate generally continuous cleaning of the classifier by preventing particle build-up from occurring or by limiting the amount of time that particle build-up is present before it is removed by the generally continuous supply of carbon dioxide particles.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A method for cleaning a particle classifier having a material inlet, a classifier wheel, a rotor, a stator ring, a material outlet, and particle build-up on at least one of the rotor and the stator, the method comprising:

providing carbon dioxide particles to at least one of the rotor or the stator; and allowing the carbon dioxide particles to interact with the particle build-up to break up the particle build-up.

2. The method according to claim 1, wherein the carbon dioxide particles are provided by feeding the carbon dioxide particles through the material inlet of the classifier.

3. The method according to claim 2, wherein the carbon dioxide particles are manually fed to the material inlet.

4. The method according to claim 1, wherein carbon dioxide particles are provided by simultaneously feeding carbon dioxide particles and particles to be classified through the material inlet.

5. The method according to claim 1, further comprising operating the classifier at a rotor speed of from about 3,000 to about 3,500 rpm.

6. The method according to claim 1, further comprising closing the material outlet.

7. A method for cleaning a particle classifier having a material inlet, an air inlet, an air outlet, a material outlet, a classifier wheel having a rotor and a stator ring, and particle build-up on at least one of the rotor and the stator, the method comprising:

(i) stopping a process for classifying particles;

(ii) feeding carbon dioxide particles through the material inlet of the classifier; and (iii) operating the rotor, thereby allowing the carbon dioxide particles to interact with and remove the particle build-up.

8. The method according to claim 7, further comprising providing an air flow through the air inlet at a rate of from about 250 $m^3$/hr to about 500 $m^3$/hr.

9. The method according to claim 7, further comprising closing the material outlet of the classifier.

10. The method according to claim 7, further comprising providing an air flow through the air inlet at a rate of from about 250 $m^3$/hr to about 500 $m^3$/hr, and closing the material outlet of the classifier thereby reducing a rate of sublimation of the carbon dioxide particles.

11. The method according to claim 7, wherein substantially all of the particle build-up is removed in less than about 30 minutes.

12. The method according to claim 7, wherein substantially all of the particle build-up is removed in less than about 15 minutes.

13. The method according to claim 7, wherein substantially all of the particle build-up is removed in less than about 10 minutes.

14. A method for cleaning a particle classifier having a material inlet, an air inlet, an air outlet, a material outlet, and a classifier wheel having a rotor and a stator ring, the method comprising:

providing particles to be classified;

providing carbon dioxide particles;

feeding particles to be classified to the classifier wheel;

operating the classifier wheel and performing a classification process; and feeding the carbon dioxide particles to the classifier wheel through the material inlet during the classification process.

15. The method according to claim 14, wherein adding carbon dioxide particles to the classifier wheel during the classification process provides a generally continuous supply of carbon-dioxide particles to interact with and remove any particle build-up on the rotor or stator.

16. The method according to claim 14, wherein adding carbon dioxide particles to the classifier wheel during the classification process cleans the classifier by preventing particle build-up.

17. The method according to claim 14, further comprising providing an air flow through the air inlet at a rate of from about 250 $m^3$/hr to about 500 $m^3$/hr.

18. The method according to claim 14, wherein the classifier wheel is operated at a rotor speed of from about 3,000 to about 3,500 rpm.

19. The method according to claim 14, wherein an air flow is provided through the air inlet at a rate of from about 250 $m^3$/hr to about 500 $m^3$/hr, and the classifier wheel is operated at a rotor speed of from about 3,000 to about 3,500 rpm.

20. The method according to claim 14, wherein the particles to be classified and the carbon dioxide particles are simultaneously fed to the classifier wheel.

* * * * *